US006817101B1

(12) United States Patent
Bohmer

(10) Patent No.: US 6,817,101 B1
(45) Date of Patent: Nov. 16, 2004

(54) HOT BLADE RAZOR

(75) Inventor: William Bohmer, Succasunna, NJ (US)

(73) Assignee: Display Matrix Corporation, Randolph, NJ (US)

( * ) Notice: Subject to any disclaimer, the term of this patent is extended or adjusted under 35 U.S.C. 154(b) by 0 days.

(21) Appl. No.: 09/560,997

(22) Filed: Apr. 28, 2000

Related U.S. Application Data

(60) Provisional application No. 60/131,408, filed on Apr. 28, 1999.

(51) Int. Cl.[7] ..... B26B 21/48
(52) U.S. Cl. ..... 30/34.05; 30/140
(58) Field of Search ..... 30/34.05, 140, 30/538

(56) References Cited

U.S. PATENT DOCUMENTS

| | | | | | |
|---|---|---|---|---|---|
| 956,604 | A | * | 5/1910 | Savoy | 30/140 |
| 1,291,318 | A | * | 1/1919 | White | 30/34.05 |
| 1,505,578 | A | * | 8/1924 | Barra | 30/140 |
| 1,552,026 | A | * | 9/1925 | Barra | 30/34.05 |
| 2,018,147 | A | * | 10/1935 | Pirwitz | 30/140 |
| 2,063,808 | A | * | 12/1936 | Henderson et al. | 30/34.05 |
| 2,225,257 | A | * | 12/1940 | Conill | 30/34.05 |
| 2,256,871 | A | * | 9/1941 | Silver | 30/34.05 |
| 2,324,148 | A | * | 7/1943 | Gravin | 30/34.05 |
| 2,622,319 | A | * | 12/1952 | Hunt | 30/34.05 |
| 5,065,515 | A | * | 11/1991 | Iderosa | 30/140 |

* cited by examiner

*Primary Examiner*—Stephen Choi
(74) *Attorney, Agent, or Firm*—John Q. McQuillan

(57) ABSTRACT

A shaving system which provides a continuously heated blade cartridge throughout the shaving stroke is attained by applying a measured amount of electric current to the blade cartridge by means of conductors connected on each side of the blade cartridge and extended in the form of contacts built into the docking end of the cartridge. The electric current is provided by a primary battery which is contained in a waterproof compartment in the shaver handle. The current provided by the battery renders opitimum heat generation in the blades in the cartridge and can be adjusted by means of resistors in series with the battery and the blade cartridge. In order to preserve the battery life, a momentary contact switch can be installed in the shaver handle which enables the user to press and hold the switch only during the shaving stroke. In the alternative, the shaving handle may also contain a rechargeable battery which can be continuously charged by storing the shaver handle in a charging stand. In the alternative, a very small primary battery sufficient to heat the blades for a fixed number of shaves may be installed in the blade cartridge along with the blades. This would remove the battery from the shaver handle and insure a fresh battery for each blade cartridge.

3 Claims, 2 Drawing Sheets

HOT BLADE RAZOR

REFERENCES TO RELATED APPLICATIONS

This application claims the priority of Provisional Applications, Ser. No. 60/131,408 filed on Apr. 28, 1999.

BACKGROUND

The present invention relates to a comfortable wet shave which is based on a number of factors such as face preparation (shaving cream etc.), proper lubricant (hot water) and high quality shaving equipment containing very sharp blades (Multiple Blade Razors). It is well known that hot water enhances the shaving experience in that the hairs are softened for easier cutting by the blade. A common practice during shaving is to place the shaver under hot running water to heat the blade to further enhance the heat effect. The combination of all the comfort factors above are magnified substantially when the blade is very hot. The blade cutting characteristics are improved due to the heat tempering effect on the metal and the hot edge softening the hair strand at the cutting location. Unfortunately this peak comfort level exists only at the beginning of the shaving stroke. The face surface reduces the temperature of the heated blade on contact because the skin surface area acts as a heat sink.

SUMMARY

The present invention preserves this peak comfort level during shaving by keeping the blade very hot during the complete shaving stroke. An improved shaving system that renders a continuously heated blade throughout the shaving stroke is attained by applying a measured amount of electric current to the blade by means of conductors connected on each side of the blade and extended in the form of contacts built into the docking end of the cartridge. The electric current is provided by a battery that is contained in a waterproof compartment in the shaver handle. The current provided by the battery is calculated to render the optimum heat generation in the blades in the cartridge. The electrical current can be adjusted by means of resistors in series with the battery and the blade. In order to preserve the battery life a momentary contact switch can be installed in the shaver handle. The momentary contact switch allows the user to press and hold the switch only during the shaving stroke. The batteries that would be installed in the shaver handle can be AA, AAA or AAAA alkaline batteries or equivalent. The shaving handle may also contain a rechargeable battery. The battery would be continuously charged by storing the shaver in a charging stand which is plugged into a standard household outlet. A very small primary battery cell sufficient for heating the blades for a fixed number of shaves may be installed in the cartridge along with the blades. This embodiment would remove the battery from the shaver handle and insure a fresh battery for each cartridge.

DETAILED DESCRIPTION

Figure 1:
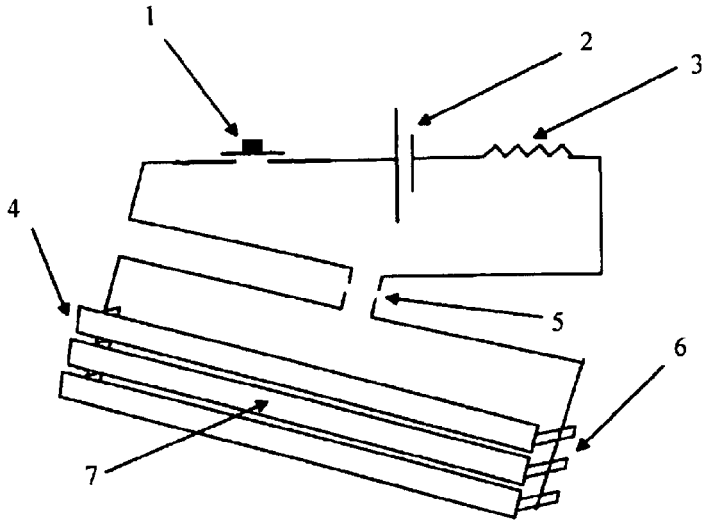
FIG. 1 is a schematic representation of the shaving system.

Referring now to the Figures in which FIG. 1 is a schematic representation of one embodiment of the invention. The cartridge section contains the three cutting blades 7 which are connected together electrically at each end at 4 and 6 and brought out to connecting means at 5. The circuit is interrupted at 5 which is the schematic representation of the junction between the cartridge section and the handle section. The handle section is composed of a momentary contact switch 1 , a battery 2 and resistor 3 brought out to the connecting means 5. When the connecting means at 5 is closed the system is ready for operation. When momentary contact switch 1 is closed and the connecting means 5 is closed current generated by the battery 2 will flow through the resistor 3 and the blades 7 rendering a heated blade. The momentary contact switch 1 must be held closed during the shaving stroke. The temperature of the heated blade is determined by the resistor value and the battery voltage.

Figure 2:
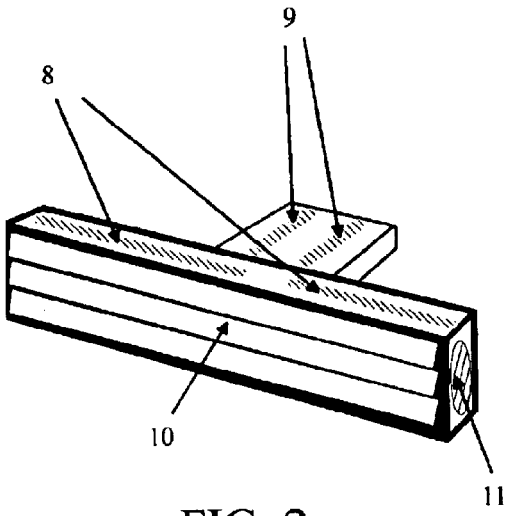
FIG. 2 shows one embodiment of the shaving cartridge.

FIG. 2 shows an embodiment of the shaving system cartridge which is composed of the housing 11, the blades 10, the internal conductors 8 and the connecting means 9 which forms the female junction.

Figure 3:
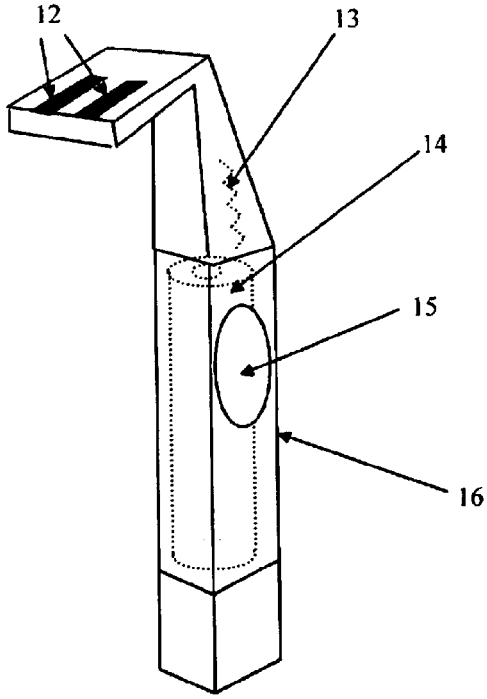
FIG. 3 shows one embodiment of the shaving handle.

FIG. 3 shows an embodiment of the shaving system handle which is composed of the connecting means 12 which forms the male junction, the current limiting resistor 13, the battery 14, the momentary contact switch 15 and the housing 16.

Figure 4:
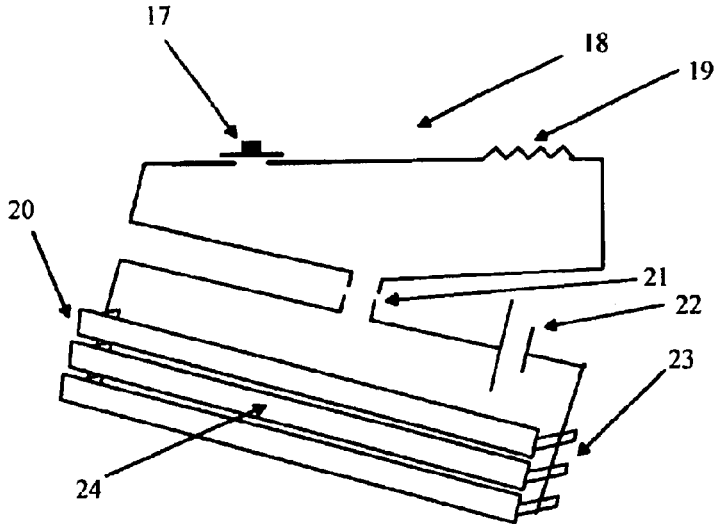
FIG. 4 is another schematic representation of the shaving system.

FIG. 4 is a schematic representation of another embodiment of the invention. This embodiment differs from the first in that a small capacity battery is included in the shaving cartridge instead of the shaving handle. The cartridge section contains three cutting blades 24 which are connected together electrically at each end at 20 and 23 and a battery 22 brought out to connecting means at 21. The circuit is interrupted at 21 which is the schematic representation of the junction between the cartridge section and the handle section. The handle section is composed of a momentary contact switch 17 and resistor 19 brought out to the connecting means 21. When the connecting means at 21 is closed the system is ready for operation. When momentary contact switch 17 is closed and the connecting means 21 is closed the current generated by the battery 22 will flow through the resistor 19 and the blades 24 rendering a heated blade. The momentary contact switch 17 must be held closed during the shaving stroke. The temperature of the heated blade is determined by the resistor value and the battery voltage.

Figure 5:
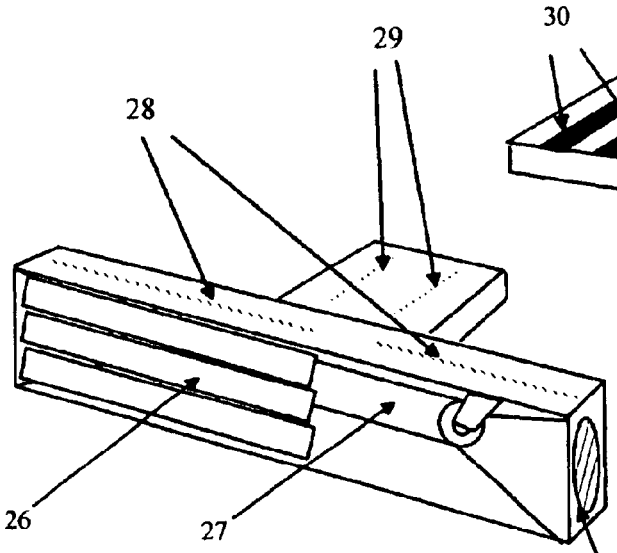
FIG. 5 shows another embodiment of the shaving cartridge.

FIG. 5 shows the shaving system cartridge which is composed of the housing 25, the blades 26, the internal conductors 28, the low capacity battery 27 and the connecting means 29 which forms the female junction.

Figure 6:
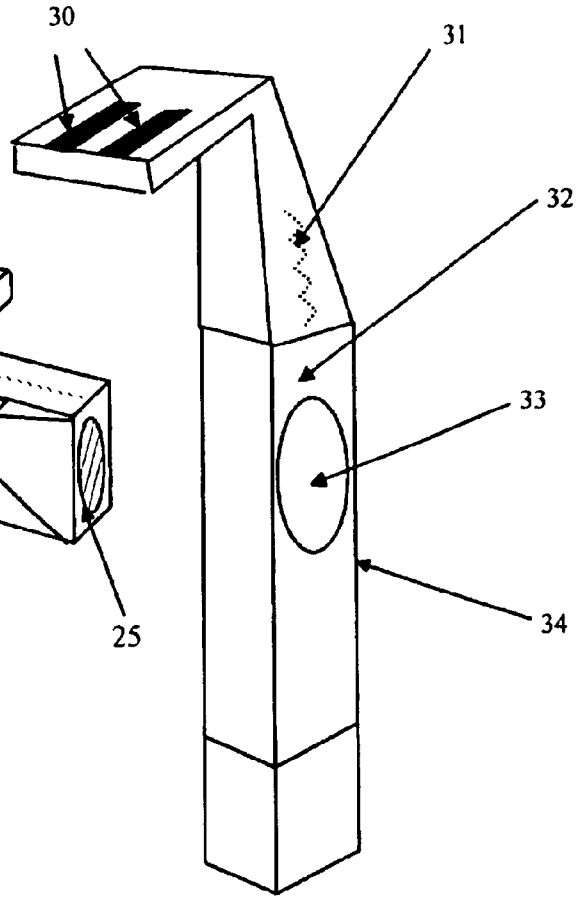
FIG. 6 shows another embodiment of the shaving handle.

FIG. 6 shows the shaving system handle which is composed of the connecting means 30 which forms the male junction the current limiting resistor 31 and the momentary, contact switch 33 and the housing 34.

It is to be understood that the above examples are for illustrative purposes only. Variations to the specific embodiments described in the examples can be made and remain within the scope of the invention.

What is claimed is:

1. A shaving system utilizing an electric current to heat an electrically conductive razor blade or blades used to cut hair on the skin;

the shaving system comprising a cartridge containing at least one of an electrically conductive narrow elongated razor blade of predetermined resistance and a plurality of closely spaced apart parallel electrically conductive narrow elongated razor blades, each of predetermined resistance;

a first conductive element connected to one end of the at least one or to one end of each of the plurality of elongated razor blades and a second conductive element connected to the other end of the at least one or to the other end of each of the plurality of the elongated razor blades;

a handle adapted to engage the cartridge to provide a means for holding and guiding the at least one razor blade or the plurality of razor blades across the skin to cut hair thereon;

a battery having a pair of terminals disposed in one of the cartridge and the handle, an electrical current control system disposed in the handle which is adapted to be electrically connected to the first and second conductive elements of the cartridge when the handle is engaged to the cartridge, the electrical control system having a momentary contact switch with a pair of contacts with one contact being connected to the first conductive element when the handle engages the cartridge, the electrical current control system further having a current control resistor in circuit with the other one of the pair of contacts being connected to the second conductive element of the cartridge, the current control resistor being in series with the one of the terminals of the battery in the cartridge or in the handle;

whereby momentary closure of the momentary contact switch enables current to flow from one terminal of the battery through the current control resistor, and through the at least one of an electrically conductive elongated razor blades and the plurality thereof to heat the razor blades for shaving.

2. A shaving system utilizing an electric current to heat an electrically conductive razor blade used to cut hair on the skin;

the shaving system comprising a cartridge containing an electrically conductive narrow elongated razor blade of predetermined resistance;

a first conductive element connected to one end of the elongated razor blade and a second conductive element connected to the other end of the elongated razor blade;

a handle adapted to engage the cartridge to provide a means for holding and guiding the razor blade across the skin to cut hair thereon;

a battery having a pair of terminals disposed in one of the cartridge and the handle;

an electrical current control system disposed in the handle which is adapted to be electrically connected to the first and second conductive elements of the cartridge when the handle is engaged to the cartridge, the electrical control system having a momentary contact switch with a pair of contacts with one contact being connected to the first conductive element when the handle engages the cartridge, the electrical current control system further having a current control resistor in circuit with the other one of the pair of contacts being connected to the second conductive element of the cartridge, the current control resistor being in series with the one of the terminals of the battery in the cartridge or in the handle;

whereby momentary closure of the momentary contact switch enables current to flow from one terminal of the battery, through the current control resistor, and through the electrically conductive elongated razor blade to heat the razor blade for shaving.

3. A system utilizing an electric current to heat an electrically conductive razor blade used to cut hair on the skin;

the shaving system comprising a cartridge containing a plurality of closely spaced apart parallel electrically conductive narrow elongated razor blades, each of predetermined resistance;

a first conductive element connected to one end of each of the plurality of elongated razor blades and a second conductive element connected to the other end of the plurality of the elongated razor blades;

a handle adapted to engage the cartridge to provide a means for holding and guiding the plurality of razor blades across the skin to cut hair thereon;

a battery having a pair of terminal disposed in one of the cartridge and the handle;

an electrical current control system disposed in the handle which is adapted to be electrically connected to the first and second conductive elements of the cartridge when the handle is engaged to the cartridge, the electrical control system having a momentary contact switch with a pair of contacts with one contact being connected to the first conductive element when the handle engages the cartridge, the electrical current control system further having a current control resistor in circuit with the other one of the pair of contacts being connected to the second conductive element of the cartridge, the current control resistor being in series with the one of the terminals of the battery in the cartridge or in the handle;

whereby momentary closure of the momentary contact switch enables current to flow from one terminal of the battery through the current control resistor and through the plurality of conductive elongated razor blades to heat the razor blades for shaving.

* * * * *